United States Patent [19]

Buser

[11] Patent Number: 4,484,109

[45] Date of Patent: Nov. 20, 1984

[54] IGNITION SYSTEM FOR GAS DISCHARGE LAMPS

[76] Inventor: Johann Buser, Ringstrasse 14, 4414 Füllinsdorf, Switzerland

[21] Appl. No.: 319,660

[22] Filed: Nov. 9, 1981

[30] Foreign Application Priority Data

Nov. 18, 1980 [DE] Fed. Rep. of Germany ..... 3043526

[51] Int. Cl.[3] ..... H05B 41/18; H01J 1/30

[52] U.S. Cl. ..... 315/290; 315/280; 315/279; 315/289; 315/DIG. 5; 313/351

[58] Field of Search ..... 315/205, 279, 289, 290, 315/362, DIG. 5, 280; 313/351

[56] References Cited

U.S. PATENT DOCUMENTS

| | | | |
|---|---|---|---|
| 2,916,671 | 12/1959 | Retzer | 315/289 |
| 3,219,880 | 11/1965 | Pett | 315/290 |
| 3,280,371 | 10/1966 | Toda et al. | 315/290 |
| 3,453,478 | 7/1969 | Shoulders et al. | 313/351 |
| 3,629,650 | 12/1971 | Brighton et al. | 315/280 X |
| 3,740,686 | 6/1973 | Jarrige et al. | 315/290 |
| 4,247,803 | 1/1981 | Walz | 315/289 |

*Primary Examiner*—Eugene R. Laroche
*Assistant Examiner*—Vincent De Luca
*Attorney, Agent, or Firm*—Michael Ebert

[57] ABSTRACT

A system operating in combination with a gas discharge lamp, such as a fluorescent lamp having electrodes therein, to effect ignition in a cold state without an ignition delay. Applied across the electrodes through a current-limiting coil is a voltage derived from a standard alternating-current supply. The supply voltage is also applied through an ignition switch to a starter coil inductively coupled to the current limiting coil to define therewith a step-up transformer, such that when this switch is closed, a high ignition voltage is imposed on the electrodes to produce an arc-discharge which heats up the electrodes. The resultant electron emission from the electrodes makes it possible to re-open the ignition switch after a brief interval, the lamp thereafter continuing to operate on the relatively low supply voltage.

10 Claims, 7 Drawing Figures

IGNITION SYSTEM FOR GAS DISCHARGE LAMPS

BACKGROUND OF INVENTION

This invention relates generally to gaseous discharge lamps of the low, medium and high pressure type, and more particularly to a system for effecting cold ignition of fluorescent lamps by momentarily applying across the electrodes thereof an ignition voltage higher than the normal operating voltage derived from a standard a-c supply (i.e., 120 or 220 volts).

In fluorescent lamps of the type in present day use, the electrodes must be preheated before ignition is initiated. In most cases, an ignition voltage whose magnitude is greater than the normal operating voltage is applied to the electrodes, the ignition voltage being generated by an induction circuit.

With conventional ignition arrangements, there is a measurable time lag between the actuation of the switch and the actual ignition of the lamp. Moreover, in many instances, several trial or false ignitions may precede the actual lamp ignition, this giving rise to disturbing flicker effects. Until such time as full ignition occurs, the full light output of the lamp is not available, this being inconvenient and annoying to the user of the lamp.

Attempts have heretofore been made to overcome delayed ignition and its attendant drawbacks. But these attempts have failed in a practical way to realize ignition of a fluorescent or other gas discharge lamp almost immediately upon closing the operating switch.

Thus British Pat. No. 512,778 discloses an ignition system in which a current-limiting or choke coil for the lamp is tapped to form an autotransformer providing a high ignition voltage. But this arrangement is not feasible, for the resultant ignition current is of such intensity that it is difficult to cope with, especially in large installations. Also, the heavy ignition current seriously deteriorates the hot cathodes and blackens the lamp in a relatively short time. Hence, the life span of such lamps is relatively short, and the resultant maintenance and replacement costs as well as shut-downs render this approach to rapid ignition uneconomical.

SUMMARY OF INVENTION

In view of the foregoing, the main object of this invention is to provide a simple and efficient ignition system for a gas discharge tube, such as a fluorescent lamp having electrodes, in which ignition is effected in a cold state without ignition delay and without subjecting the electrodes to wear and tear.

More specifically, an object of this invention is to provide a system of the above type in which momentarily applied across the electrodes is a high ignition voltage giving rise to an immediate arc discharge, the lamp otherwise operating normally with a supply voltage in the low voltage range.

A significant advantage of the invention is that the ignition voltage is obtained by simple transformation of a standard alternating supply voltage without the need for high frequency voltages or other costly expedients.

Briefly stated, these objects are attained in a system in accordance with the invention in which the supply voltage from a standard a-c power line is applied through a current-limiting coil across the electrodes of the gas discharge lamp and through an ignition switch to a starter coil inductively coupled to the current-limiting coil to define a step-up transformer therewith, such that when the ignition switch is closed, a high ignition voltage is applied across the electrodes which results in an immediate arc discharge and immediate full lighting of the lamp without any flickering or undue delay.

The heating of the electrodes resulting from the arc-discharge gives rise to electron emission therefrom, whereby after only a brief interval, preferably determined by a few cycles of the alternating supply voltage, one is able to cut off the ignition switch and dispense with the high ignition voltage, the lamp continuing to operate on the relatively low supply voltage.

In contradistinction to the tapped autotransformer arrangement disclosed in the above-identified British patent which produces a heavy ignition current, the present two-coil transformer arrangement makes it possible to optimize induction in proportion to the ohmic resistance, thereby limiting the energy of the ignition current surge.

In the present arrangement, current-limiting coil performs its usual function in the lamp circuit, the starter coil being used only to momentarily step-up the voltage applied to the electrodes; hence the starter coil may be economically designed for momentary rather than continuous operation. The two-coil transformer arrangement not only affords immediate ignition, but also acts to provide a long operating life for the lamp and to reduce energy consumption.

A significant feature of the invention resides in a lamp provided with electrodes having discharge or emission spikes. By giving these spikes a tulip-like divergent shape, the electrodes will heat up without a significant dinimution of the arc. The ensuing avalanche-like production of electrons effectively bridges the transition between the ignition and operating voltages. Moreover, as distinguished from prior arrangements, with the present invention the ignition gas pressure can be raised to achieve optimum ignition conditions and an improved luminous power output.

During ignition, care must be taken to make hard bombardment of the cathode as brief as possible in order to avoid damaging the electron emitting material by evaporation occurring in a very short period. For this reason, the electrode cups are produced from metal containing thorium, the cups being used to keep the first impact of electrons as low as possible, thereby minimizing disintegration of the material. Ignition in accordance with the invention makes use of an ignition voltage no higher than necessary to effect ignition in order to facilitate the transition from the high to the relatively low operating voltage without disintegration of the material.

In a system in accordance with the invention, the ignition period is no longer than a few cycles of the a-c supply, this being achieved either with a manually-operated switch or an automatic electronic timing circuit that controls the ignition interval—such as a programmed phase shift control, it being desirable to set the switching at the zero-crossing of the a-c cycles.

OUTLINE OF DRAWINGS

For a better understanding of the invention as well as other objects and further features thereof, reference is made to the following detailed description to be read in conjunction with the accompanying drawings, wherein.

Figure 6:
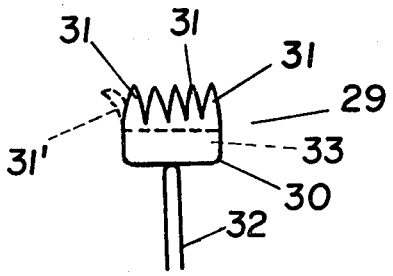

FIG. 6 schematically illustrates a preferred form of lamp electrode; and

Figure 7:
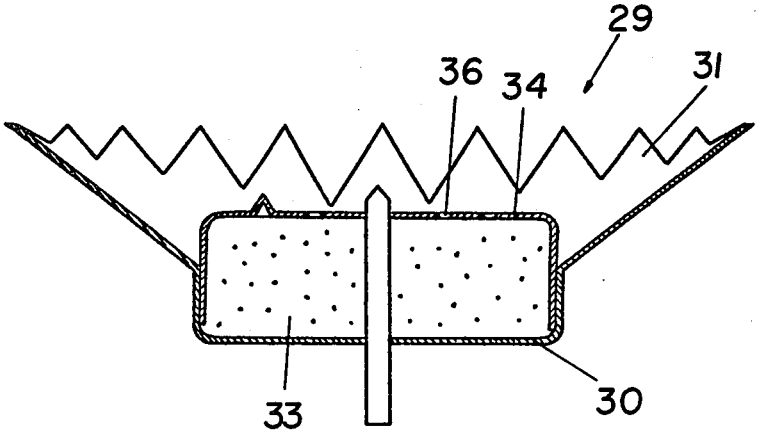

FIG. 7 shows a modified lamp electrode structure.

DESCRIPTION OF INVENTION

First Embodiment

Figure 1:
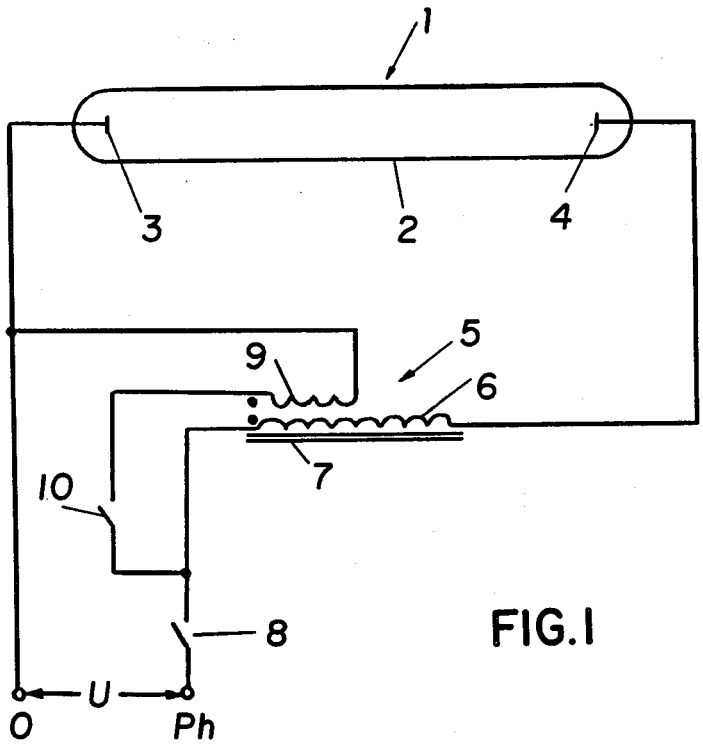
FIG. 1 illustrates schematically a preferred embodiment of an ignition system in accordance with the invention in combination with a gas discharge lamp.

Referring now to FIG. 1, there is shown a gaseous discharge lamp 1 provided with a gas-filled tube 2 under negative pressure. Disposed within tube 2 at opposite ends thereof are two electrodes 3 and 4, preferably pre-activated in a known manner. The discharge tube, which may be of any known type, in the present example is a fluorescent tube.

Electrode 3 is connected to the neutral terminal "O" of a commercial a-c power line or standard mains supply. The other electrode 4 is connected to one end of a current-limiting coil 6 of a current-limiting device 5 having an iron core 7. Current-limiting device 5 is connected in series with discharge lamp 1 to limit current flow in the lamp and to stabilize its operation in a known manner. The other end of current-limiting coil 6 is connected to the phase terminal PH of the power line via a main switch 8, this switch being shown schematically. In the present example, the voltage U between terminals 0 and PH is 220 volts.

Connected between supply terminals 0 and PH via an ignition switch 10 is a starter coil 9, switch 10 being shown schematically. As will be later evident, this switch may take a mechanical, electromechanical or electronic form. When switch 10 is closed, the corresponding ends of coils 6 and 9 are interconnected and the starter coil, which is inductively coupled to current-limiting coil 6 functions as the primary of a step-up transformer whose secondary is coil 9.

Operation

We shall now describe how the ignition system operates. When main switch 8 is closed, ignition switch 10 is simultaneously caused to close in a manner to be later explained in connection with FIGS. 2 and 3. As a consequence, supply voltage U is supplied to the primary of the transformer formed by starting coil 9 to induce a voltage in the secondary formed by current-limiting coil 6. The transformer has a step-up ratio such that the stepped-up voltage yielded by current-limiting coil 6 and applied across electrodes 3 and 4 has a magnitude sufficient to effect an instantaneous arc-discharge between the electrodes.

This arc discharge acts to heat up electrodes 3 and 4. The resultant electron emission is sufficient to maintain the arc so that after a brief interval it is no longer necessary to provide an ignition voltage higher than supply voltage U. Hence at this point, ignition switch 10 is opened to isolate starter coil 9, current-limiting coil 6 then assuming the exclusive function of stabilizing the operation of the ignited discharge lamp 1.

The step-up ratio of coils 6 and 9 is selected to provide an ignition voltage for electrodes 3 and 4 which is at least double that of supply voltage U. This means that the number of turns of starter coil 9 is, at most, half the turns of current limiting coil 6. It has been established that when coils 6 and 9 have a step-up ratio of 3:1, with a nominal voltage U of 220 V, it becomes possible to perfectly ignite a fluorescent tube of conventional commercial design.

At a nominal supply voltage U, ignition switch 10 is preferably re-opened within 10 cycles of the a-c supply voltage, thereby isolating starting coil 9. Such isolation of starting coil 9 is possible because, as previously noted, an elevated ignition voltage is no longer required after an arc between electrodes 3 and 4 is established. Thus starter coil 9 may be designed to operate for brief intervals only, rather than continuously and may therefore be of inexpensive design.

Mechanical Switching Unit

Figure 2:
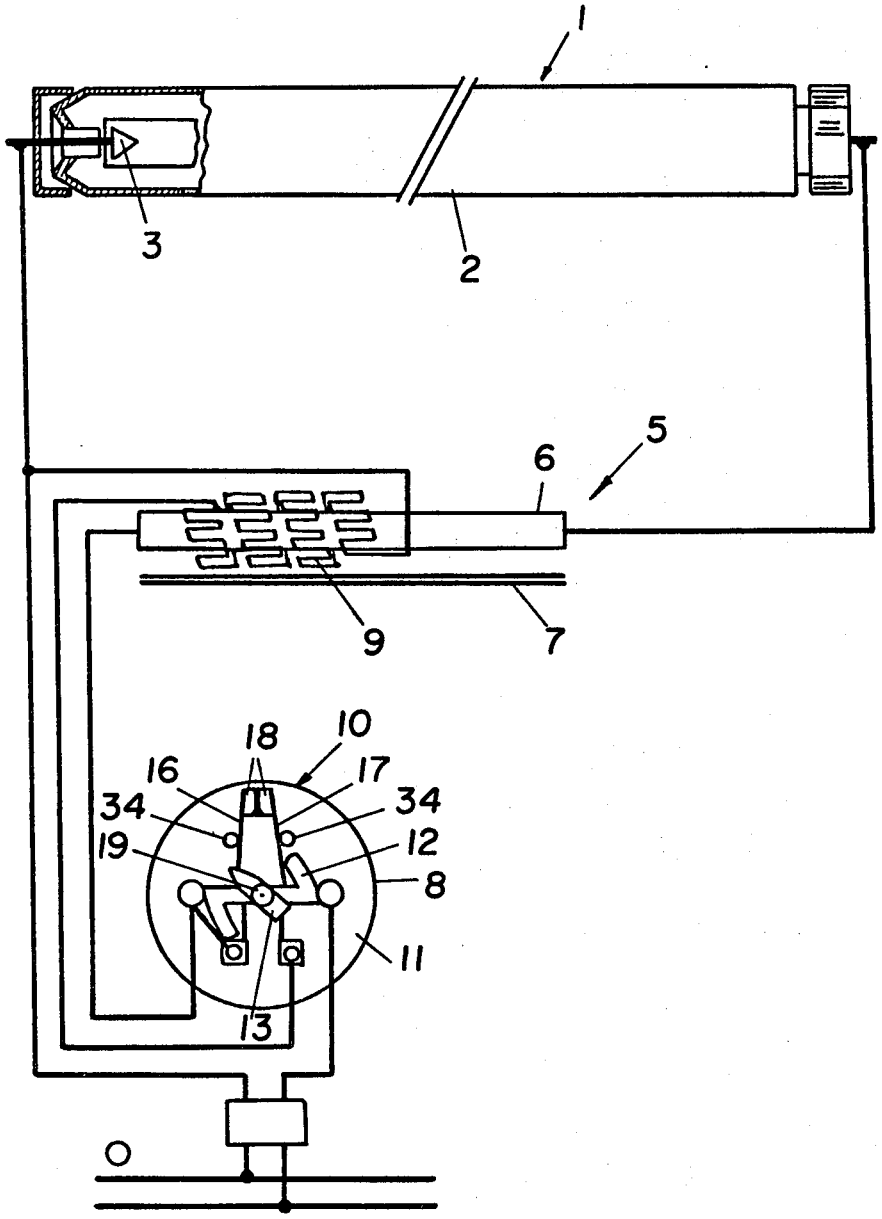
FIG. 2 shows the design for an ignition system of the type shown in FIG. 1 which includes a mechanical switching unit.

In FIG. 2, there is illustrated an actual working embodiment of the system, elements corresponding to those shown in FIG. 1 being identified by like reference numerals.

In FIG. 2, discharge tube 1 is provided with filament-type electrodes, such as electrode 3. Starter coil 9 is wound over current-limiting coil 6 in a zig-zag shaped course, thereby maintaining a high absolute resistance. Coil 9 may be made of thin gauge wire or stamped out of sheet metal.

Main switch 8 and ignition switch 10 are combined in this instance into a single mechanical switching unit 11. In unit 11, main switch 8 includes a Z-shaped wiping contact blade 12 which is rotated to assume its "on" or "off" position by means of a rotary operating member 13.

Figure 3:
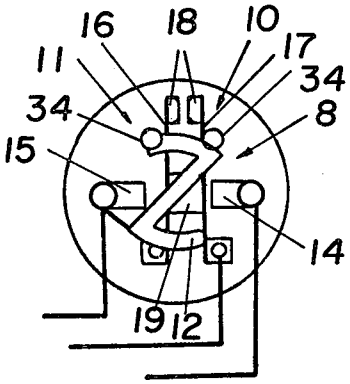
FIGS. 3 and 4 show the mechanical switching unit in different switching positions.
Figure 4:
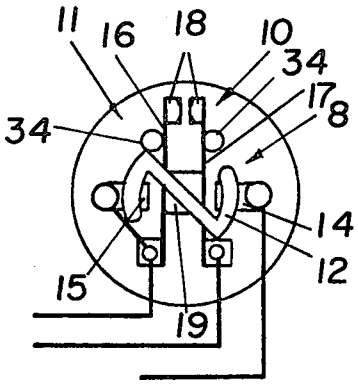

As best seen in FIGS. 3 and 4, contact blade 12 cooperates with two fixed contacts 14 and 15, contact 14 being connected to phase terminal PH. Contact 15 is connected to one end of current-limiting coil 6 as well as to a control spring 16. Contact spring 16 has a contact 18 supported thereon which, when it engages the complementary contact 18 on contact spring 17, is connected to one end of starter coil 9. It will be seen that contact springs 16 and 17 normally rest against respective fixed stops 34. Interposed between contact springs 16 and 17 is an operating shaft 19 of rectangular or square cross section which is coupled to operating member 13, so that as member 13 is turned, shaft 19 is also turned.

FIG. 3 shows the switched-off position of switching unit 11, in which position contact blade 12 is out of contact with fixed contacts 14 and 15, thereby opening main switch 8, in which operating shaft 19 interposed between contact springs 16 and 17 is then oriented to hold contacts 18 apart, so that ignition switch 10 is then open.

By rotating operating member 13 in the clockwise direction to an intermediate position, the legs of contact blade 12 are then caused to engage contacts 14 and 15, as shown in FIG. 2, thereby closing switch 8. At the same time, square shaft 19, which is positioned by operating member 13, is now oriented so that contact springs 16 and 17 are bent toward each other to cause contacts 18 to touch each other, thereby closing switch 10.

Thus at the intermediate position of switching unit 11, the supply voltage U is fed across the electrodes of the lamp through current-limiting coil 6, and the supply voltage is at the same time applied to the starting coil 9 (see FIG. 1) to effect an arc discharge. Upon continued rotation of operating member 13 into the final position shown in FIG. 4, contact springs 16 and 17 are then caused to return to their neutral position to disengage contacts 18, thereby re-opening ignition switch 10. On the other hand, in the final position, contact blade 12 remains connected to fixed contacts 14 and 15, thereby keeping the main operating switch 8 closed.

Thus at the intermediate position of switching unit 11, the supply voltage U is fed across the electrodes of the lamp through current-limiting coil 6, and the supply voltage is at the same time applied to the starting coil 9 (see FIG. 1), to effect an arc discharge. Upon continued rotation of operating member 13 into the final position shown in FIG. 4, contact springs 16 and 17 are then caused to return to their neutral position to disengage contacts 18, thereby re-opening ignition switch 10. On the other hand, in the final position contact blade 12 remains connected to fixed contacts 14 and 15, thereby keeping the main operating switch 8 closed.

Thus in the course of rotation of contact blade 12 from its switched-off to its switched-on position, contacts 18 of ignition switch 10 are momentarily brought together. In order to avoid a situation in which the square shaft 19 at the intermediate position of the switching unit prolongs closure of contacts 18 of the ignition switch 10, springs may be provided (not shown) to quickly return the shaft to the position shown in FIG. 4, in which contacts 18 are disengaged. While a rotary operation has been shown for mechanical switching unit 11, in practice, the operating member may be in push-button or toggle form.

Electronic Switching Unit

Figure 5:
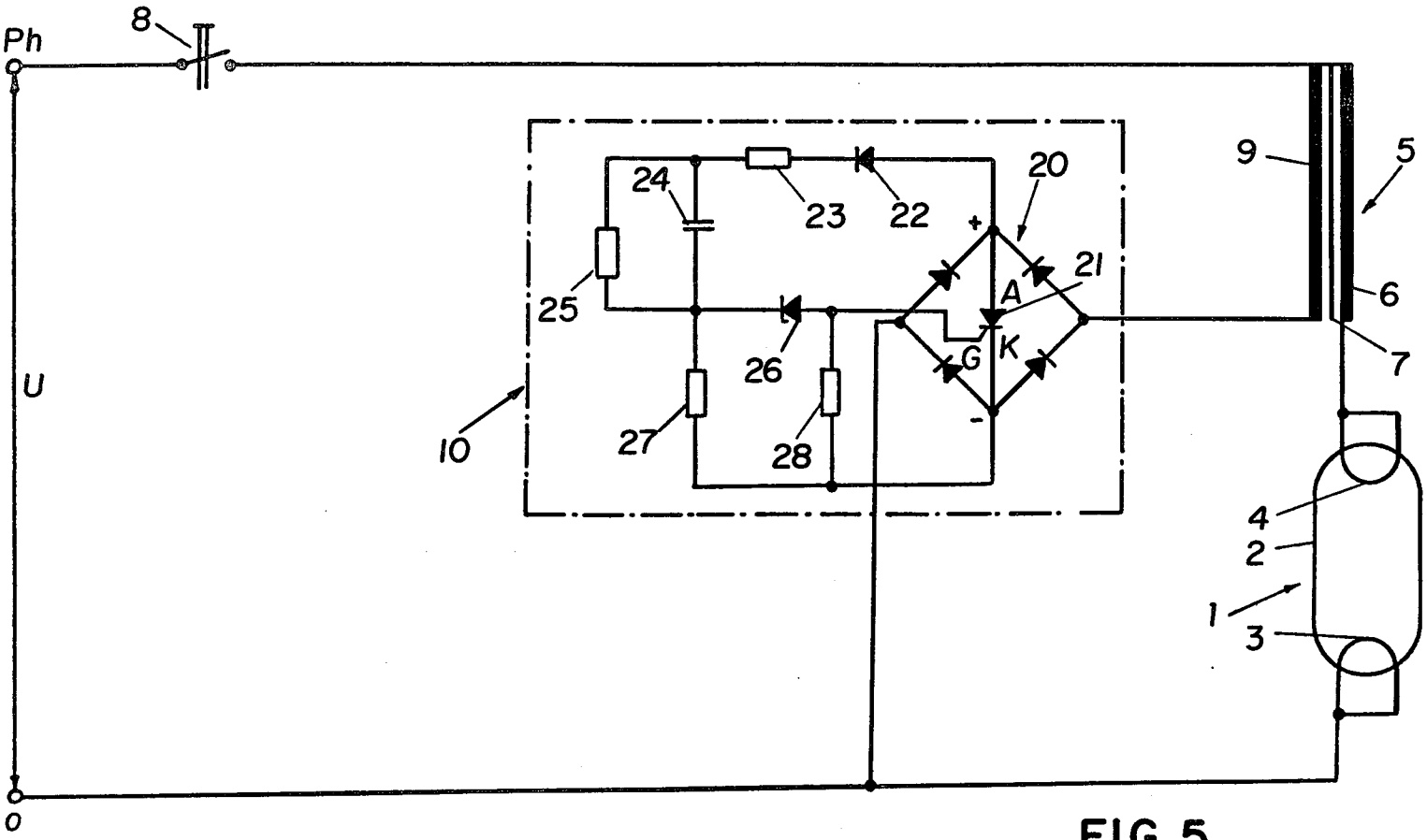
FIG. 5 illustrates schematically a second embodiment of the invention, use being made in this instance of an electronic switching unit.

Referring now to FIG. 5, it will be seen that the ignition switch in this instance is constituted by an electronic circuit rather than a mechanical device. In this arrangement, electronic ignition switch 10 is interposed between the neutral terminal "O" of the supply U and one end of starter coil 9, whose other end and the corresponding end of current-limiting coil 6 are connected through main switch 8 to the terminal PH of the supply.

Each of electrodes 3 and 4 in discharge tube 1 is composed of a spiral-wound filament whose ends are interconnected so that the electrode functions as a cold electrode. Electrode 3 is connected to neutral terminal "O," while electrode 4 is connected to the other end of current-limiting coil 6.

In electronic switch 10, a full-wave bridge rectifier 20 has its input connected between one end of starter coil 9 and the neutral terminal "O" of the supply to produce a d-c output across which is connected a thyristor 21. The positive side of the rectifier output is connected to anode A and the negative to cathode K of thyristor 21.

The positive side of the rectifier output is also connected through a diode 22 in series with a resistor 23 to one end of a chargeable capacitor 24, across which is shunted a resistor 25, the other end of capacitor 24 being connected through a Zener diode 26 to the gate G of thyristor 21. One end of Zener diode 26 is connected through resistor 27 to the negative side of the rectifier output, the other end being similarly connected through resistor 28.

The operation of the electronic switch arrangement in FIG. 5 is functionally similar to that shown in FIG. 1. At the outset, capacitor 24 is in its discharged state; but when main switch 8 is actuated, the rectified supply voltage is applied across this capacitor which then proceeds to charge.

The voltage across the charging capacitor 24 is applied to the gate G of the thyristor; and when this voltage reaches an ignition level, the thyristor is fired, thereby initiating a discharge of the capacitor. But at zero-crossing of supply voltage U, thyristor 21 switches off, thereby interrupting capacitor discharge. This action is repeated in the next half cycle of supply voltage U, as a consequence of which capacitor 24 again proceeds to charge until a gate ignition pulse is again generated.

The firing and extinguishing of thyristor 21 resulting from the charging and discharging of capacitor 24 is repeated until the voltage established across capacitor 24 reaches a predetermined level whose magnitude depends on the Zener voltage characteristic of Zener diode 26 and the magnitude of supply voltage U. As soon as capacitor 24 is charged to this predetermined level, no ignition pulses go to gate G of thyristor 21 which thereafter remains extinguished; hence starter coil 9 remains in a disabled state.

Thus the interval in which capacitor 24 charges up to the predetermined level determines the switched-on time interval of starter coil 9. Since the magnitude of the predetermined voltage level, as previously noted, depends in part on the magnitude of supply voltage U, the switched-on time interval of starter coil 9 changes with supply voltage U. This arrangement ensures a switched-on time interval for starter coil 9 that, with a nominal supply voltage U, amounts to a maximum of 10 cycles of the a-c supply.

One can with appropriate circuit expedients eliminate the dependence of the switched-on time interval of starter coil 9 on supply voltage U. Because in FIG. 5, the operation of electronic ignition switch 10 is independent of main switch 8, it may be physically separated therefrom, so that switch 10 may be installed within the lamp fitting, preferably adjacent the current-limiting device. It therefore becomes possible by means of a single main switch 8 to switch "on" and "off" a plurality of gas discharge lamps.

In practice, instead of using a thyristor, as shown in FIG. 5, to switch starter coil 9 "on" when main switch 8 is closed; and to automatically switch it off after a predetermined interval, use may be made of other controlled semiconductor elements for this purpose. Also, the ignition switching device may take the form of a suitable electromechanical device in a relay circuit. This too has the advantage over a mechanical switching unit as being placeable at a site removed from that of switch 8.

The ignition system described hereinabove makes possible safe, reliable and flickerless ignition of discharge lamps, regardless of the form of the electrodes therein. In conventional arrangements for the ignition of a discharge lamp, preheating of the electrodes is usually required, this giving rise to deficiencies which are largely neglected. The greatest disadvantage lies in the relatively long interval between the heating up of the electrodes and the emission of electrons to ignite the lamp.

While switching systems are now known which include expedients acting to suppress the annoying intermittent pre-ignitions experienced with conventional arrangements, these expedients do not reduce the time required to heat up the filaments of the glow electrode. A further drawback encountered with pre-heating arrangements resides in the fact that the circuit is arranged as a shunt, so that after the shunt circuit is switched off, the two lead-in wires for the lamp needed for heating the filament are only fed on one side when reverting to normal operation.

After ignition, the arc chooses the shortest path; that is, the path of least resistance, to the side of the current supply for the electrodes where the filaments are connected to the supply voltage by lead-in wires. These spots are then overheated, causing evaporation of the emitting layer. The resultant overheating adversely affects the life span of the lamp. The annoying flickering of the electrodes in discharge lamps also stems from this arrangement. This disadvantage can be eliminated by shorting the two lead-in wires for the filament of the electrode.

Electrode Desisn

Immediate and easy ignition can be achieved with lamp electrodes equipped, as shown schematically in FIG. 6, with discharge and emitting spikes.

Electrode 29 includes a metal cup 30 provided at its rim with an array of discharge and emitting spikes 31, a connector 32 being attached to the base of the cup. Inside of metal cup 30 is a substance 33 formed of electron emissive material, preferably oxides of rare earth.

When an elevated ignition voltage is applied to the electrode, ignition of the arc discharged is facilitated and accelerated by discharge spikes 31. This design has the further advantage of preventing the arc from traveling along the electrode.

It is especially desirable to have the discharge spikes 31 bent to diverge from the longitudinal axis of the lamp in the manner indicated in dotted lines by spike 31'. In this design, the discharge spikes are not parallel to each other but flare outwardly in a tulip-like formation. This design is advantageous in that the arc is started in a circular configuration normal to the longitudinal axis of the lamp. Thus ignition takes place in the plane of the electrode spikes at right angles to the center-line of the lamp, thereby achieving low material loss in normal operation.

FIG. 7 shows an alternative design for the lamp electrode 29 which is easier to produce and has a substantially longer life span. Electrode 29, in this instance, also has a metal cup 30 provided along its rim with discharge and emitting spikes 31. However, a cover 34 is provided to avoid loss of powder material from the emissive filler 33.

Cover 34 is provided with an array of small perforations 36 in the direction of the discharge path. As a result, the electron beam is filtered through a sieve and the arc emerges in a manner comparable to that of a soft water jet.

Thus the invention makes possible a cold start, even with filament electrodes, a result not heretofore feasible. And because of the arrangements disclosed herein, the life span of the electrodes are extended, for there is no direct impact of ions and electrons on the emissive material, the first impact striking the easily heatable emitting spikes of the metal cup which is preferably fabricated of molybdenum containing thorium.

Because in the present invention the number of electrons is determined by demand, there is no overheating and erosion in particular spots. There is no preheating system, as in prior devices, which can at best only be adjusted inaccurately. And because the spiked front end of the electrode is at right angles to the center line of the lamp, preference is not given to certain spots. Finally, the heat conductance of the electrode is ideal, for the first ignition surge immediately initiates the normal operating condition.

In summary, a system in accordance with the invention makes use of separate starter and current limiting coils in an operating arrangement suitable for low, medium or high pressure discharge lamps with preactivated electrodes which are protected against an excessive current surge on cold start. Consequently, the discharge process has no wear and tear effects and is not damaging to the life span of the lamp. Blackening of the lamp is virtually eliminated, the lamp installation being reliable, economical to operate and long-lasting.

While there have been shown and described preferred embodiments of an ignition system for gas discharge lamps in accordance with the invention, it will be appreciated that many changes and modifications may be made therein without, however, departing from the essential spirit thereof.

I claim:

1. In combination with a gas discharge lamp such as a fluorescent lamp having electrodes, a system for effecting cold start ignition of the lamp comprising:

A first means including a current-limiting coil in series with a main switch which when actuated serves to apply across the electrodes through said current limiting coil a relatively low voltage derived from a standard a-c power line; and B second means including a starter coil in series with an ignition switch, said starter coil being inductively coupled to the current-limiting coil to define therewith a step-up transformer, said ignition switch being momentarily actuated when the main switch is actuated to apply said voltage to said starter coil to produce in said current-limiting coil an ignition voltage which is applied across the electrodes for a brief interval at a raised level sufficient to effect an immediate arc discharge, the lamp thereafter being operated by said low voltage, said main switch and said ignition switch being mechanical switches that are mechanically interlinked, whereby actuation of the main switch effects momentary actuation of the ignition switch.

2. The combination as set forth in claim 1, wherein said electrodes are provided with an electronic emissive substance and have a structure provided with discharge and emitting spikes which are bent outwardly relative to the cental axis of the electrodes.

3. The combination as set forth in claim 2, in which said structure includes a cup to contain said substance ad whose rim is formed into said spikes.

4. The combination as set forth in claim 2, wherein said substance is constituted by oxides of rare earth.

5. The combination as set forth in claim 4, wherein said cup is fabricated on a refractory material.

6. The combination as set forth in claim 5, wherein said material is molybdenum containing thorium.

7. The combination as set forth in claim 1, wherein said transformer has a step-up ratio of at least 1 to 2.

8. The combination as set forth in claim 7, wherein said current-limiting coil has a number of turns at least double the number contained by the starter coil.

9. The combination as set forth in claim 1, wherein said brief interval is no greater than about 10 cycles of the a-c power.

10. The combination as set forth in claim 1, wherein said interlinked switches are constituted by a rotary mechanism turnable from an "off" to an "on" position and provided with main switch contacts which become engaged as the mechanism is turned and remain engaged at the "on" position, an ignition switch contacts which become engaged momentarily as the mechanism is turned and are disengaged at the "on" position.

* * * * *

UNITED STATES PATENT OFFICE

CERTIFICATE OF CORRECTION

Patent No. 4,484,109 Dated Nov. 20, 1984

Inventor(s) Johann Buser

It is certified that error appears in the above-identified patent and that said Letters Patent are hereby corrected as shown below:

Column 8, line 46: change "ad" to --and--

Column 8, line 50: change "on" to --of--

Column 8, line 65: change "an" to --and--

Signed and Sealed this

*Twenty-third* Day of *April 1985*

[SEAL]

*Attest:*

DONALD J. QUIGG

*Attesting Officer* *Acting Commissioner of Patents and Trademarks*